US006752056B1

(12) United States Patent
Weber

(10) Patent No.: US 6,752,056 B1
(45) Date of Patent: Jun. 22, 2004

(54) INTERCALATED SHEET FEEDING DEVICE FOR A COLD CUTS SLICER

(75) Inventor: Guenther Weber, Bad Lassphe (DE)

(73) Assignee: Weber Maschinenbau GmbH & Co. KG (DE)

( * ) Notice: Subject to any disclaimer, the term of this patent is extended or adjusted under 35 U.S.C. 154(b) by 41 days.

(21) Appl. No.: 09/980,171

(22) PCT Filed: Jun. 5, 2000

(86) PCT No.: PCT/EP00/05130

§ 371 (c)(1),
(2), (4) Date: Mar. 5, 2002

(87) PCT Pub. No.: WO00/76733

PCT Pub. Date: Dec. 21, 2000

(30) Foreign Application Priority Data

Jun. 10, 1999 (DE) ..... 199 26 461

(51) Int. Cl.[7] ..... B26D 7/18

(52) U.S. Cl. ..... 83/98; 83/104; 83/109; 83/932; 53/389.2; 53/435; 53/513

(58) Field of Search ..... 83/98, 932, 86, 83/99, 100, 102, 417, 355, 88–94, 104, 109; 53/123, 513, 157, 517, 435, 389.1, 389.3, 389.4, 389.2; 414/21

(56) References Cited

U.S. PATENT DOCUMENTS

| | | | | | |
|---|---|---|---|---|---|
| 3,019,578 | A | | 2/1962 | Cohen | |
| 3,481,746 | A | * | 12/1969 | Clemens et al. | 426/420 |
| 3,815,319 | A | | 6/1974 | Vedvik | |
| 4,405,186 | A | * | 9/1983 | Sandberg et al. | 414/21 |
| 4,583,435 | A | | 4/1986 | Fessler | |
| 4,586,409 | A | * | 5/1986 | Kuchler | 83/112 |
| 4,852,441 | A | * | 8/1989 | Anders et al. | 83/155 |
| 4,913,019 | A | * | 4/1990 | Hayashi | 83/367 |
| 4,960,025 | A | * | 10/1990 | Fitch | 83/703 |
| 5,051,268 | A | | 9/1991 | Mally | |
| 5,343,790 | A | * | 9/1994 | Kuhrt | 83/395 |
| 5,784,936 | A | * | 7/1998 | King | 83/145 |

FOREIGN PATENT DOCUMENTS

| | | |
|---|---|---|
| DE | 1940063 | 6/1966 |
| DE | 3727358 A1 | 5/1988 |
| DE | 3249925 C2 | 6/1990 |
| DE | 4125539 A1 | 2/1993 |
| DE | 4402923 A1 | 8/1995 |
| DE | 19646619 A1 | 5/1998 |

* cited by examiner

*Primary Examiner*—Allan N. Shoap
*Assistant Examiner*—Phong Nguyen
(74) *Attorney, Agent, or Firm*—Townsend and Townsend and Crew LLP

(57) ABSTRACT

The invention relates to an apparatus for cutting food products. The apparatus includes a support for a food product, a blade, and an intercalated sheet feeding device, which guides a free end of a continuous strip by using compressed air.

13 Claims, 2 Drawing Sheets

INTERCALATED SHEET FEEDING DEVICE FOR A COLD CUTS SLICER

The present invention relates to an apparatus for the slicing of food products in accordance with the preamble of claim 1.

Such apparatuses are generally known from the prior art (cf. U.S. Pat. No. 3,019,578) and serve to slice a food product and to separate the cut product slices from one another by intercalated layers, for example inserted paper sheets. It has, however, generally proved to be problematic to achieve a proper insertion of the intercalated sheet at the slicing speeds usual today.

It is the object of the present invention to improve an apparatus of the kind first mentioned such that a proper insertion of intercalated sheets is possible between individual, cut product slices even at very high slicing speeds with low constructive effort.

This object is solved by the features of claim 1 and in particular by the intercalated sheet feeding device having a compressed air device which introduces compressed air into a region between a continuous strip and a cutting plane. In accordance with the invention, the compressed air is thus introduced between the continuous strip and the cutting plane such that a partial vacuum can be produced between the continuous strip and the product located on the product support by use of the hydrodynamic paradox. An air flow is thus produced between the surface of the product located in the cutting plane and the continuous strip which has the effect that the pressure becomes lower in this region between the continuous strip and the food product than the air pressure outside this region and thus also the air pressure at the other side of the continuous strip. The continuous strip is thereby sucked toward the surface of the product located in the cutting plane. The continuous strip can, however, not contact the product since the continuously supplied air flow prevents this.

The apparatus of the invention has an extremely simple constructional design and needs only a few mechanically moving parts.

Advantageous embodiments of the invention are described in the description, the drawing and the dependent claims.

In accordance with a first advantageous embodiment, the intercalated sheet feeding device can have at least one air outlet which is orientated approximately at a right angle to the cutting plane. Such an orientation of the air outlet has shown unexpectedly good results, even though one would expect that an air flow orientated in this manner would not bring the continuous strip into contact with the product in the direction of the cutting plane, but would prevent such a contact.

In accordance with a further advantageous embodiment, the intercalated sheet feeding device can have at least one air outlet which—seen in the cutting plane—extends approximately over the whole region of the product support. It is ensured in this way that the desired suction of the continuous strip is ensured over substantially the whole width of the food product to be sliced.

The intercalated sheet feeding device preferably has a substantially horizontal outlet for the continuous strip which is preferably arranged in the region of the cutting plane. Such an arrangement has proved to be advantageous in particular with a product support arranged at a slope with respect to the horizontal axis (angle of inclination, for example, around 40°), since it is hereby ensured that the continuous strip first exits in the horizontal direction, but is subsequently sucked parallel to the cutting plane by the partial vacuum produced. It is particularly advantageous if the exit of the continuous strip and the air outlet of the intercalated sheet feeding device are mutually orientated at an acute angle of around 30° to 40°, in particular around 35°, since particularly good results were able to be achieved therewith in trials.

The intercalated sheet feeding device can have an outlet for the continuous strip which can simultaneously serve as a counter blade for the continuous strip. A separate cutting device can be provided for the cutting off of a section of the continuous strip. It is, however, also possible to separate a section of the continuous strip by the cutting procedure, that is by the knife rotating in the cutting plane.

In accordance with a further advantageous embodiment of the invention, the intercalated sheet feeding device can have at least one drive roll or drive roller which effects the feed of the continuous strip. The exit of the continuous strip can be provided either beneath the product supply or also above the product to be sliced.

In accordance with a further advantageous embodiment of the invention, the intercalated sheet feeding device is arranged above the product support so that the intercalated sheet material is supplied from the top to the bottom in front of the product. This embodiment has the advantage that cutting residues and contamination arising during cutting cannot enter into the region of the intercalated sheet feeding device. Furthermore, a simpler replacement of an empty roll of intercalated sheet material is possible.

The present invention is described below purely by way of example by means of an advantageous embodiment and with reference to the enclosed drawing.

FIGS. 1 and 2 are collectively referred to as "the Figures" below.

Figure 1:
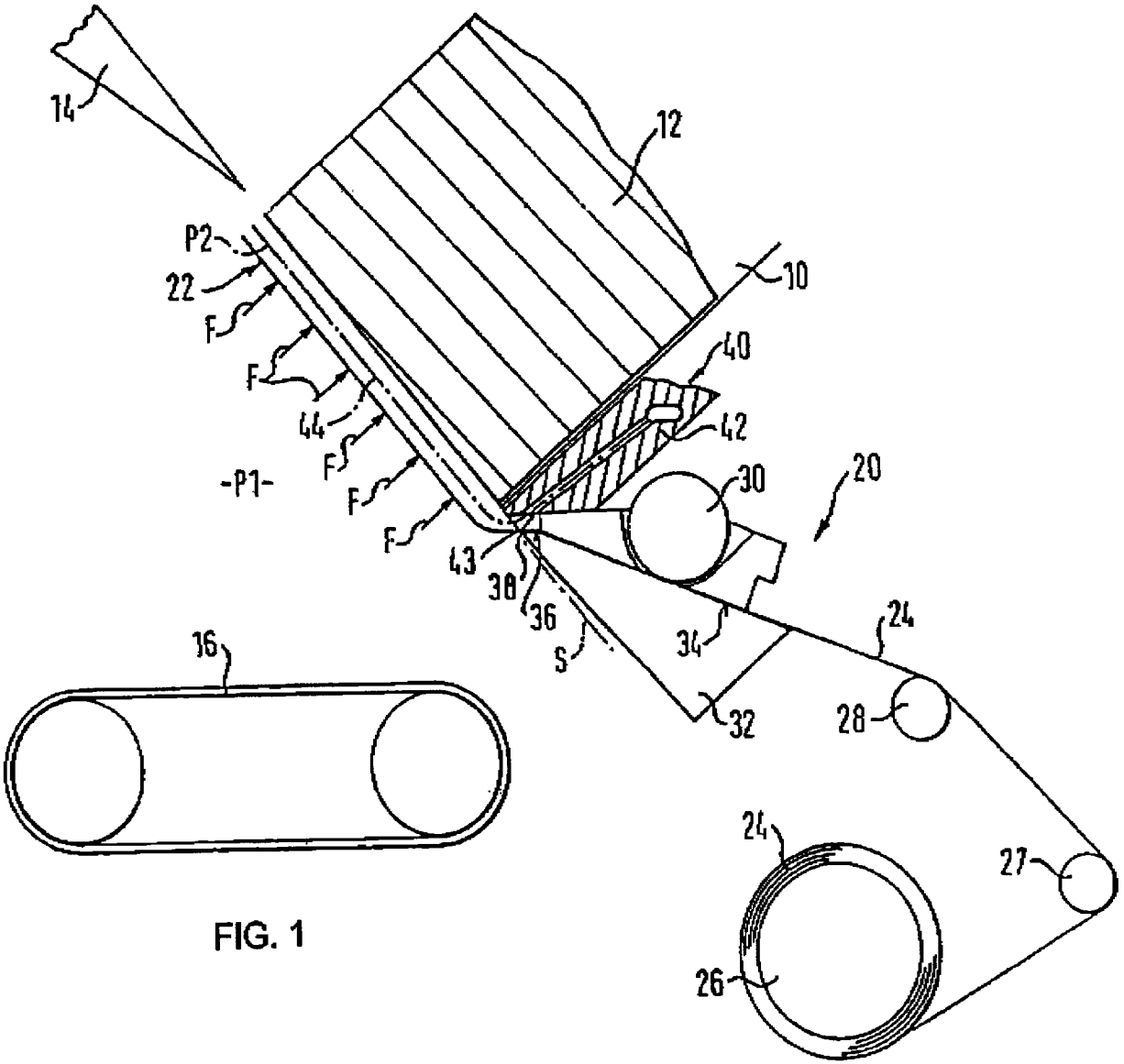
FIG. 1 shows the side view of an apparatus of the invention in schematic form.
Figure 2:
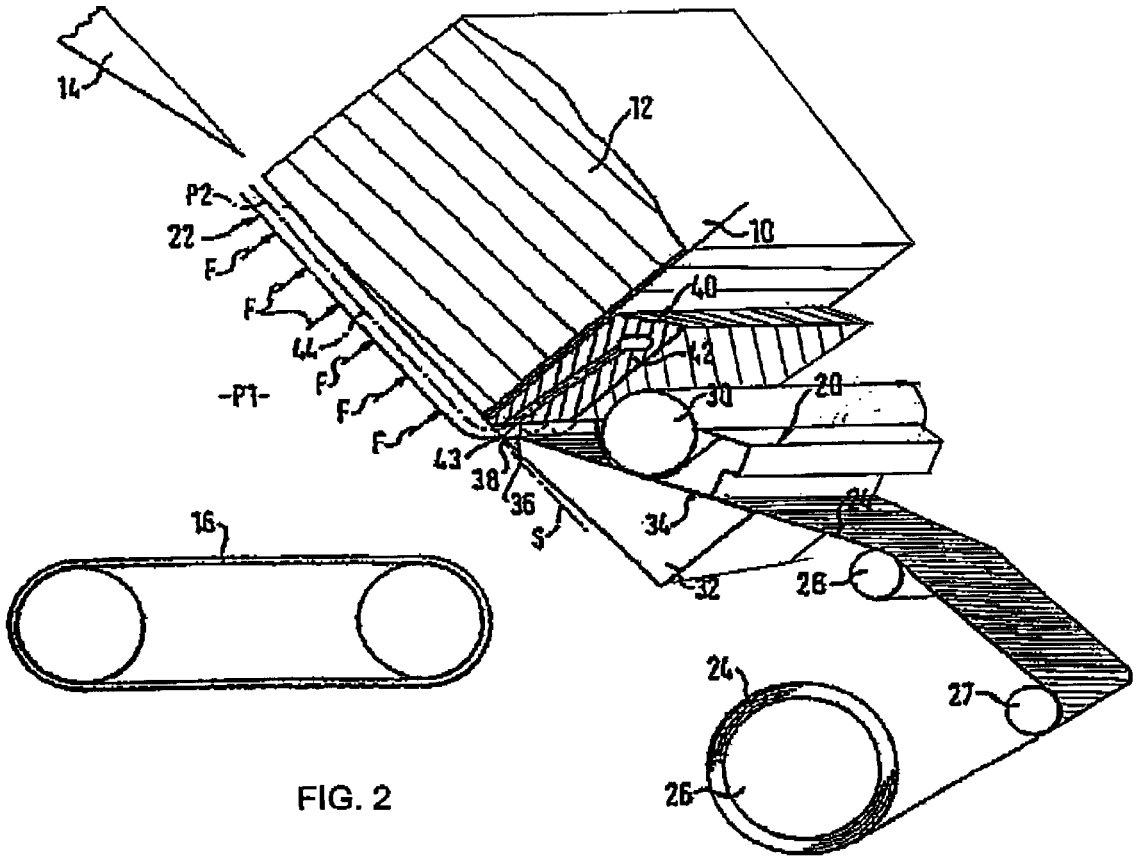
FIG. 2 shows a perspective view of the apparatus in schematic form

The Figures schematically show an apparatus for the slicing of food products, in particular sausage, ham, cheese and the like, comprising a product support 10 on which a schematically represented food product 12 is arranged. The product support 10 is arranged at an angle of around 40° to the horizontal axis and the food product 12 is supplied in the direction of a cutting plane S from a feed device (not shown).

A knife 14 that is formed as a rotary cutting knife, on the one hand rotates around its own axis or rotation and, on the other hand, is driven in a planetary orbit in the cutting plane S. In this way, individual product slices can be cut off the product 12 by the product feed device (not shown) being moved forward accordingly. The cut product slice then falls onto a conveyor belt 16 on which a stack of product slices or a shingled arrangement of product slices can be formed.

An intercalated sheet feeding device 20 is provided, which guides the free end 22 of a continuous strip 24 in front of the front end of the product support 10, to provide each cut product slice with an intercalated sheet. The continuous strip 24 can, for example, be a paper web which is unwound from a reel 26 and is guided around deflecting rolls 27 and 28. A driven roll 30 is provided, which is arranged in the region of a drive block 32, for the feed of the continuous strip 24.

As the Figures show, the drive block 32 has a slanted supply plane 34 which extends at an angle of around 20° to the horizontal axis. The supply plane 34 merges into an outlet 36 which extends substantially horizontally and whose outer edge 38 is in the cutting plane S and serves as a counter blade for the cutting of the free end 22 of the continuous strip 24 by the knife 14.

The intercalated sheet feeding device 20 furthermore has a compressed air device 40 which comprises a compressed air rail 42. Compressed air is supplied toward the continuous strip 24, preferably over the whole effective width of the product support 10, by the compressed air rail 42, with the air outlet 43 of the compressed air rail 42 and the outlet 36 of the intercalated sheet feeding device 20 being mutually orientated at an angle of around 35°. Compressed air is in this way introduced into a region between the free end 22 of the continuous strip 24 and the cutting plane S, whereby an air flow 44 arises which produces a pressure P2 between the product 12 and the free end 22 of the continuous strip 24 which is lower than the air pressure P1 in the region in front of the free end 22 of the continuous strip 24. In this way, a force F is produced which presses the free end 22 of the continuous strip 24 in the direction of the product 12. A sticking of the continuous strip to the product 12 can, however, not take place, since the air flow 44 prevents this.

In operation, the product 12 is advanced by the feed device from the position shown in the Figures by a distance corresponding to the slice width, whereupon the cutting knife 14 orbits in a planetary manner in the cutting plane S and thereby separates a product slice form the product 12. After this cutting procedure, the knife 14 separates the free end 22 of the continuous strip 24 at the edge 38 of the intercalated sheet feeding device 20 serving as the counter blade. At the same time, the cut product slice falls onto the conveyor belt 16, with the cut section of the continuous strip 24 sticking to the underside of the product slice when it meets the conveyor belt 16.

When the cutting knife 14 is retracted for the next cutting cycle, the driven roll 30 of the intercalated sheet feeding device 20 is actuated, whereupon the continuous strip 24 is conveyed and rolled off the reel 26 so far that its free end 22 is located in the position shown in the Figures. A state is in turn achieved by the simultaneously supplied compressed air such as is shown in the Figures and was described above.

What is claimed is:

1. An apparatus for the slicing of food products, the apparatus comprising:

a product support for supporting a food product;

a knife capable of moving in a cutting plane to cut the food product; and a sheet feeding device which guides a free end of a continuous strip in front of a front end of the product support, wherein the sheet feeding device comprises a compressed air device positioned to introduce compressed air into a region between the continuous strip and the cutting plane.

2. The apparatus of claim 1 wherein the knife is positioned to cut both the food product and the continuous strip in the same cutting plane.

3. The apparatus of claim 1 wherein the sheet feeding device includes a drive block and a drive roll, and wherein the continuous strip is fed between the drive block and the drive roll.

4. The apparatus of claim 1 wherein the sheet comprises paper.

5. The apparatus of claim 1 wherein the compress air device is positioned to introduce the compressed air into the region between the continuous strip and the cutting plane so that the air flow from the compressed air device is parallel to the cutting plane.

6. The apparatus of claim 1 wherein the compressed air device is positioned to introduce compressed air into a region between the continuous strip and the food product.

7. An apparatus for the slicing of food products, in particular sausage, ham, cheese and the like, comprising a product support (10), a knife (14) rotating in a cutting plane (S) and an intercalated sheet feeding device (20) which guides the free end (22) of a continuous strip (24) in front of the front end of the product support (10) to me available an intercalated sheet between cut product slices, characterized in that the intercalated sheet feeding device (20) comprises a compressed air device (40) which introduces compressed air into a region between the continuous strip (22, 24) and the cutting plane (S), wherein the intercalated sheet feeding device produces a partial vacuum (P2) between the continuous strip (22, 24) and the product surface located in the cutting plane (S).

8. An apparatus in accordance with claim 7, characterized in that the intercalated sheet feeding device (20) has at least one air outlet (43) which is orientation approximately at a right angle to the cutting plane (S).

9. An apparatus in accordance with claim 7, characterized in that the intercalated sheet feeding device (20) has at least one air outlet (43).

10. An apparatus in accordance with claim 7, characterized in that the intercalated sheet feeding device (20) has a substantially horizontal outlet (36) for the continuous strip (24) which is arranged in the region of the cutting plane (S).

11. An apparatus in accordance with claim 7, characterized in that an outlet (36) of the continuous strip (24) and an air outlet (43) of the intercalated sheet feeding device (20) are mutually orientated at an angle of between about 30° to 40°.

12. An apparatus in accordance with claim 7, characterized in that the intercalated sheet feeding device (20) has an outlet (36) for the continuous strip.

13. An apparatus in accordance with claim 7, characterized in that the intercalated sheet feeding device (20) has a drive roller (30) which feeds the continuous strip (24).

* * * * *

UNITED STATES PATENT AND TRADEMARK OFFICE

CERTIFICATE OF CORRECTION

PATENT NO. : 6,752,056 B1
DATED : June 22, 2004
INVENTOR(S) : Guenther Weber

It is certified that error appears in the above-identified patent and that said Letters Patent is hereby corrected as shown below:

Column 4,
Line 7, change “compress” with -- compressed --
Line 22, change “me” with -- make --

Signed and Sealed this

Seventh Day of September, 2004

JON W. DUDAS
*Director of the United States Patent and Trademark Office*